US008689989B2

(12) United States Patent
Lane

(10) Patent No.: US 8,689,989 B2
(45) Date of Patent: Apr. 8, 2014

(54) DRINK BOTTLE AND LID WITH BUTTON RELEASE AT BACK OF LID

(75) Inventor: Marvin Lane, Round Lake Beach, IL (US)

(73) Assignee: Thermos L.L.C., Schaumburg, IL (US)

( * ) Notice: Subject to any disclaimer, the term of this patent is extended or adjusted under 35 U.S.C. 154(b) by 206 days.

(21) Appl. No.: 13/407,238

(22) Filed: Feb. 28, 2012

(65) Prior Publication Data

US 2013/0220966 A1 Aug. 29, 2013

(51) Int. Cl.
*A47G 19/22* (2006.01)
*B65D 43/16* (2006.01)

(52) U.S. Cl.
USPC ..... 215/237; 215/305; 215/388; 215/245; 220/254.5; 220/264; 220/709; 220/835; 222/556

(58) Field of Classification Search
USPC ..... 220/709, 254.5, 835, 834, 833, 262, 220/263, 264, 705, 715; 215/388, 305, 244, 215/245, 237; 222/556
See application file for complete search history.

(56) References Cited

U.S. PATENT DOCUMENTS

| | | | |
|---|---|---|---|
| 4,742,928 | A | 5/1988 | Braun |
| 5,203,468 | A | 4/1993 | Hsu |
| 5,244,113 | A | 9/1993 | Stymiest |
| 5,282,541 | A | 2/1994 | Chen |
| 6,279,773 | B1 | 8/2001 | Kiyota |
| D455,611 | S | 4/2002 | Kitamura et al. |
| D529,339 | S | 10/2006 | Carreno et al. |
| D538,110 | S | 3/2007 | Kitamura et al. |
| D547,607 | S | 7/2007 | Forsman |
| D586,184 | S | 2/2009 | Miller et al. |
| D590,661 | S | 4/2009 | Kitamura et al. |
| D592,012 | S | 5/2009 | Carreno |
| D596,460 | S | 7/2009 | Nezu |
| D608,640 | S | 1/2010 | Carreno |
| D609,964 | S | 2/2010 | Lane |
| D610,402 | S | 2/2010 | Carreno |

(Continued)

FOREIGN PATENT DOCUMENTS

| | | |
|---|---|---|
| DE | 4117220 | 5/1992 |
| DE | 102006060143 | 7/2008 |

(Continued)

OTHER PUBLICATIONS

Gocontigo—Autospout Addison Water Bottle—24 oz.

(Continued)

*Primary Examiner* — Anthony Stashick
*Assistant Examiner* — James N Smalley
(74) *Attorney, Agent, or Firm* — Schiff Hardin LLP

(57) ABSTRACT

A drink bottle with a removable lid includes an inner lid attached to the mouth of the bottle and an outer lid pivotably mounted on the inner lid. A drink spout extends from the inner lid. The outer lid may be locked into a closed position covering the drink spout. A push button on the inner lid can be operated to release the locked outer lid, permitting the outer lid to open to permit drinking from the drink spout. The push button moves a lid slide that extends opposite to the hinge and contains an extension that engages with a notch in the upper lid to hold the upper lid closed. On actuating the push button, the lid slide is pulled toward the push button and the extension at the other end of the lid slide moves out of engagement of the outer lid, thereby opening the outer lid.

18 Claims, 6 Drawing Sheets

SECTION A-A

(56) References Cited

U.S. PATENT DOCUMENTS

| | | | |
|---|---|---|---|
| D652,256 | S | 1/2012 | Eyal |
| D653,082 | S | 1/2012 | George |
| D663,209 | S | 7/2012 | Maas et al. |
| 2003/0034323 | A1 | 2/2003 | Smith et al. |
| 2004/0217139 | A1 | 11/2004 | Roth |

FOREIGN PATENT DOCUMENTS

| | | |
|---|---|---|
| JP | 2000128218 | 5/2000 |
| JP | 2003205958 | 7/2003 |
| JP | 2007320618 | 12/2007 |
| WO | 9624533 | 8/1996 |
| WO | 2011030830 | 3/2011 |

OTHER PUBLICATIONS

Zojirushi product—Stainless Steel Vacuum Bottle Model No. ST-KA12.

Thermos catalog of Kids Lunch Kits and Food Storage, 2007, page showing Thermos FUNtainer bottle and lid, item 24227BA 006 and four photographs showing the FUNtainer lid.

DRINK BOTTLE AND LID WITH BUTTON RELEASE AT BACK OF LID

BACKGROUND OF THE INVENTION

1. Field of the Invention

The present invention relates to a drink bottle having a removable lid, where the removable lid has an inner lid with a spout and an openable hinged outer lid. More specifically, the invention is directed to drink bottle where the outer lid is attached to the inner lid by a hinge on one side, held closed by a moveable extension engaging with a notch in the outer lid and openable by actuating a push button that moves the extension out of engagement with the notch.

2. Description of the Related Art

Personal beverage bottles are becoming ever more popular and have moved beyond the common beverage bottle packed with a school lunch or in a lunch box. Gyms are filled with members exercising, and many members bring their own beverage bottles for hydration. Hikers, bikers, walkers, commuters, tourists and many others carry beverage bottles as they go on their way. An increasingly common feature of the beverage bottles is a drink nozzle or spout that offers the ability to drink from the bottle without complete removal of the lid from the bottle. Another feature of some drink bottles is a cover for the drink spout or nozzle to keep the spout or nozzle clean between drinking.

SUMMARY OF THE INVENTION

The present invention provides a beverage bottle with a removable lid wherein the lid has an inner lid with a drink spout and an outer lid or cover that is hinged to selectively cover the drink spout. The outer lid may be locked to the inner lid when in the closed positioned. A push button on the inner lid can be operated to release the locked outer lid, permitting the outer lid to open so as to permit drinking from the drink spout. The push button is mounted on a pivot structure and connected on one side to one end of a lid slide. The other end of the lid slide extends to a portion on the inner lid opposite to the hinge and contains an extension that engages with a notch in the upper lid to hold the upper lid closed. On pressing on one side of the push button towards the radial center of the bottle, the other side of the push button moves away from the radial center of the bottle and pulls the lid slide with it. The extension located on the other end of the lid slide moves out of engagement of the outer lid, thereby opening the outer lid.

In one embodiment, a biasing element causes the lid to be moved into the fully open position. The biasing element may be made of a flexible, resilient material that, when deformed, moves back into its original position.

In another embodiment of the invention, the lid slide is biased by a biasing element so that the extension that holds the outer lid in the closed position protrudes into its engagement position except when pressure is placed on the push button.

DETAILED DESCRIPTION OF THE PREFERRED EMBODIMENTS

Various embodiments now will be described more fully hereinafter with reference to the accompanying drawings, which form a part hereof, and which show, by way of illustration, specific embodiments. However, this invention may be embodied in many different forms and should not be construed as limited to the embodiments set forth herein. Rather, these embodiments are provided so that this disclosure will be thorough and complete, and will fully convey the scope of the invention to those skilled in the art. The following detailed description is not to be taken in a limiting sense.

Throughout the specification and claims, the following terms take the meanings explicitly associated herein, unless the context clearly dictates otherwise. The phrase "in one embodiment" does not necessarily refer to the same embodiment, although it may. Furthermore, the phrase "in another embodiment" does not necessarily refer to a different embodiment, although it may. Thus, as described below, various embodiments of the invention may be readily combined without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Figure 1:
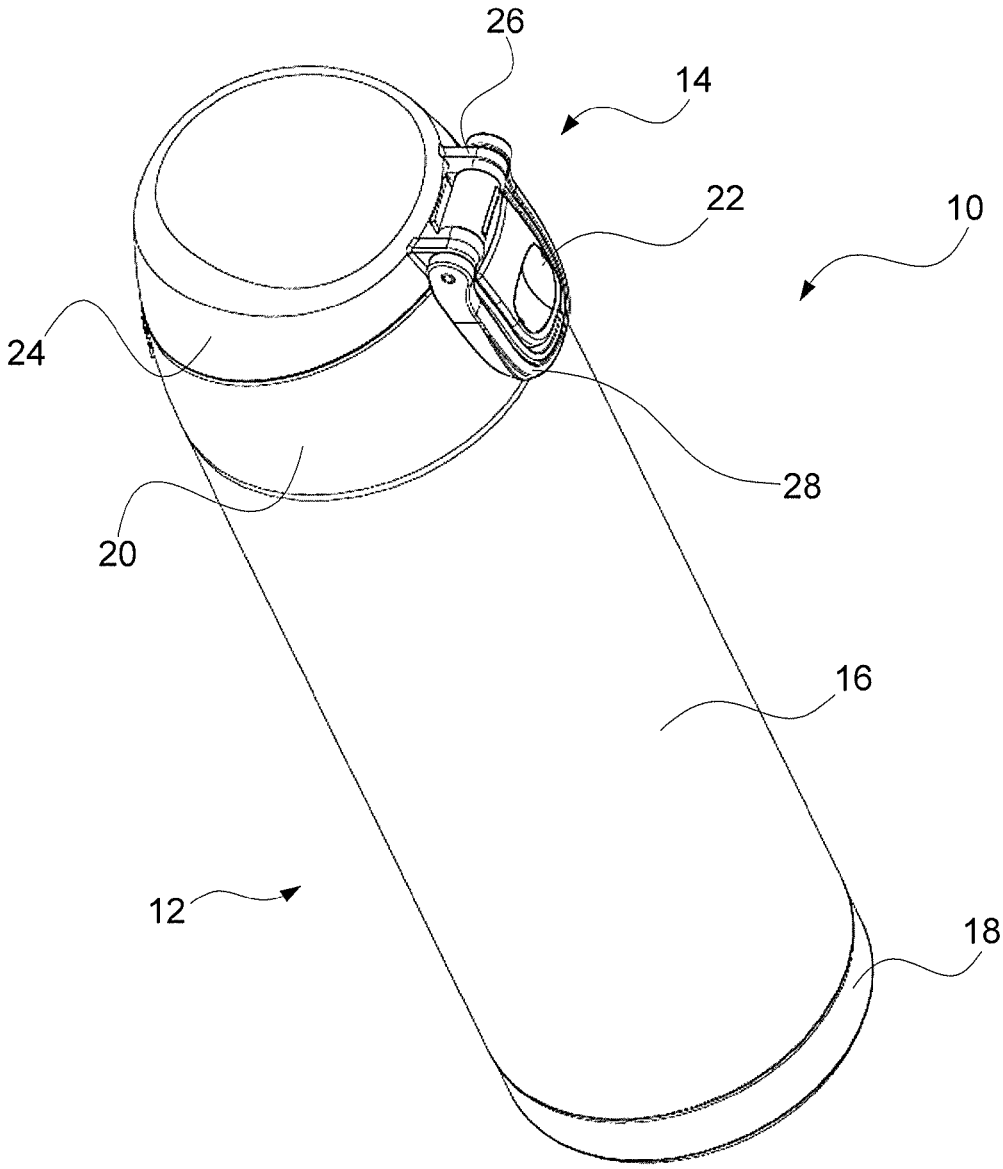
FIG. 1 is a top perspective view showing a drink bottle according to the principles of the present invention.

Referring first to FIG. 1, a beverage bottle 10 includes a bottle body 12 to which is attached a removable lid 14. The bottle body 12 may be of any suitable material, including metal, plastic, glass, rubber and combinations thereof and may be insulated or un-insulated. In the illustrated embodiment, the bottle body 12 is formed of an insulated stainless steel body part 16 on the bottom of which is fastened a plastic or rubber base 18. The bottle body 12 of one embodiment is of a double-walled construction between which is an evacuated space, forming a so-called vacuum bottle. The lid of the present invention may be used on a rigid bottle, as illustrated, or on a flexible bottle. The flexible bottle permits the user to squeeze the bottle to force the beverage from the bottle, while the rigid bottle requires the user to draw the liquid out of the bottle through suction or by pouring the liquid from the bottle. The bottle 10 has the base 18 that provides protection for the bottom of the bottle as well as providing a relatively wide surface on which the bottle is rested when standing. The base is of a plastic material, such as polypropylene, although other materials are of course possible. The bottle body 16 may have a smooth or contoured surface that may be provided with patterns, such as by printing, painting, embossing or otherwise.

The removable lid 14 is secured to the mouth of the bottle 12 by a threaded connection in the illustrated embodiment. Threads are formed about the mouth of the bottle 12 and cooperating threads are formed within the lid 14 so that the lid 14 may be threadably attached to and detached from the bottle 12. The bottle 12 may be a narrow-mouth bottle or a wide-mouth bottle; a wide-mouth bottle is shown. Other fastening means to attach the lid 14 to the bottle 12 may be provided instead, such as a snap-on lid that fits onto a rim on the bottle, a bayonet attachment, or other lid attachment structure.

The removable lid 14 has an inner lid 20, a push button 22, an outer lid 24 and a hinge 26 that connects the inner lid 20 to the outer lid 24. A handle 28 may be attached to inner lid 20 and/or outer lid 24 to provide a convenient method of carrying the bottle 10 or attaching the bottle 10 to a backpack, gym bag or the like. Outer lid 24 may be either in the closed position or open position. In the closed position, as shown in FIG. 1, outer lid 24 covers the top of inner lid 20. The outer lid 24 is movable to the open position after a user releases the locking mechanism by pressing the push button 22.

Figure 2:
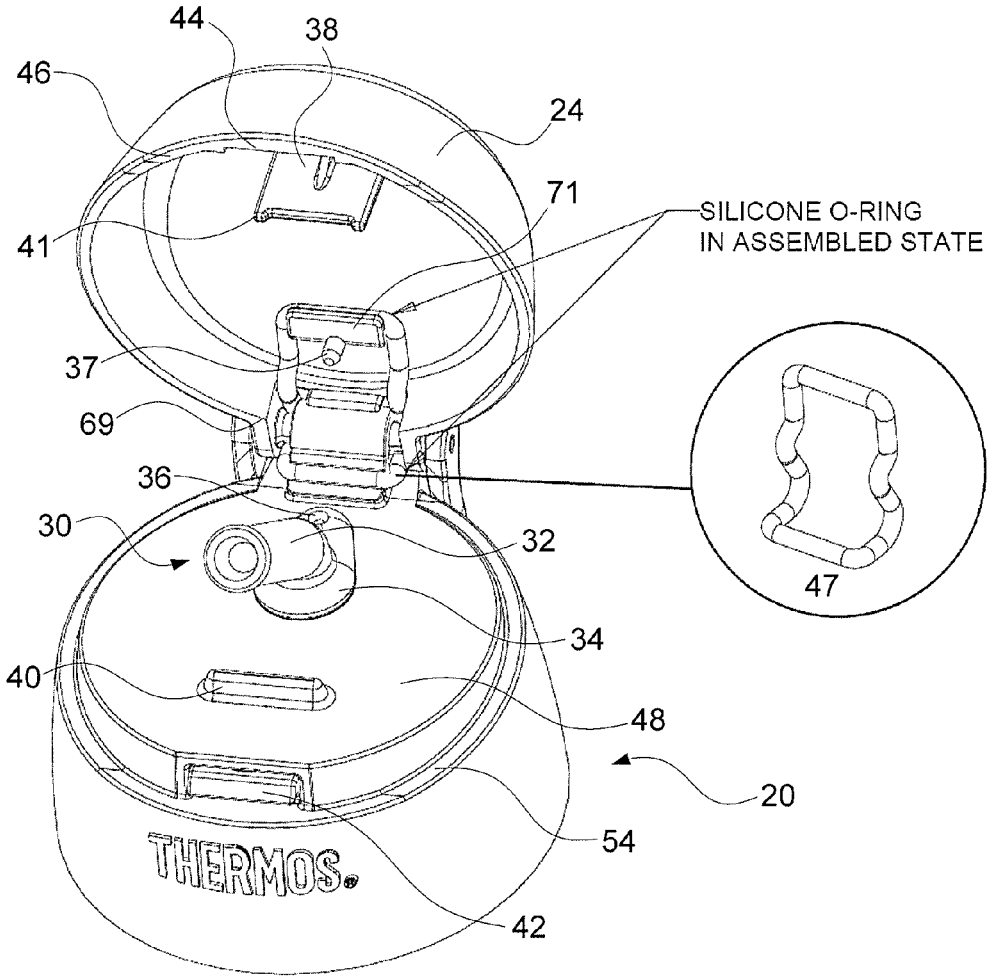
FIG. 2 is a top perspective view of the removable lid of the present invention and including a separate view of a biasing element.

The removable lid 14 is shown in the open position in FIG. 2, which provides access to drink spout 30. Drink spout 30 may be comprised of drinking tube 32 that extends through inner lid 20 which is then connected to an internal straw (not shown) and into the interior of body bottle 12. The user may drink from the bottle while keeping the bottle upright by sipping from the spout 56. The straw preferably extends to the bottom of the body bottle 12 and may extend coaxially within the bottle or extend at an angle to a lower corner of the bottle, for example.

Drink spout 30 is mounted through pedestal 34. Pedestal 34 provides structural support for drink spout 30 and helps to keep drink spout 30 oriented in a direction away from hinge 26 and open outer lid 24 to make drinking from the drink spout 30 easier for the user. Pedestal 34 may contain vent hole 36 that provides a passageway to the interior of body bottle 12. When a user drinks through drink spout 30, the liquid in body bottle 12 is drawn through the internal straw and out from drinking tube 32. The removal of liquid from the bottle may cause a negative air pressure within the bottle, especially for rigid bottle configurations. By providing vent hole 36, the negative pressure within body bottle 12 is prevented by the inflow of air into the bottle through the vent, thereby making drinking from the bottle easier. The vent hole 36 in the pedestal 34 is closed by a vent pin 37 that extends from the interior of the outer lid 24. Closing of the vent hole 36 when the lid is closed helps prevent leaking of the liquid from the drink bottle, for example when the bottle is stored on its side such as when placed into a school locker or gym bag. When the outer lid 24 is opened, the vent pin 37 moves clear of the vent hole 36, permitting the flow of air into the interior of the bottle 10 when a user drinks from the spout 30. If the present lid is to be used on a flexible squeeze bottle in which the user squeezes the bottle to force the beverage from the drink spout, the vent hole and the vent closing pin may not be necessary.

The spout 30 is formed of a pliable material, such as silicon rubber that flexes and bends readily. When the outer lid 24 is moved to the closed position, a bending flange 38 extending from the inner surface of the outer lid presses on the spout 30 and bends it down from the upwardly angled position shown in FIG. 2. The downwardly flexed spout 30 presses against a counter ridge 40 on the inner lid 20. The counter ridge 40 is mounted on the top surface of inner lid 20. The combined effect of the bending flange 38 and the counter ridge 40 is to pinch the spout 30 so as to close the spout and prevent leakage of fluid from the drink bottle 10. The bending flange 38 on the inside of the outer lid 24 may have projections 41 on either side to keep the drink spout 30 centered on the flange 38 when closing the outer lid 24.

Outer lid 24 is kept in the closed position over inner lid 20 by the engagement of catch extension 42 that protrudes from an opening at a front of inner lid 20 with catch notch 44 located on circumferential lower edge 46 of outer lid 24. Catch extension 42 is moved out of engagement with catch notch 44 by actuating push button 20. After catch extension 42 is disengaged from catch notch 44, in one embodiment, outer lid 24 is biased into the fully open position at least in part by lid biasing element. The details of the lid biasing mechanism and lid release mechanism are described in more detail below.

Figure 3:
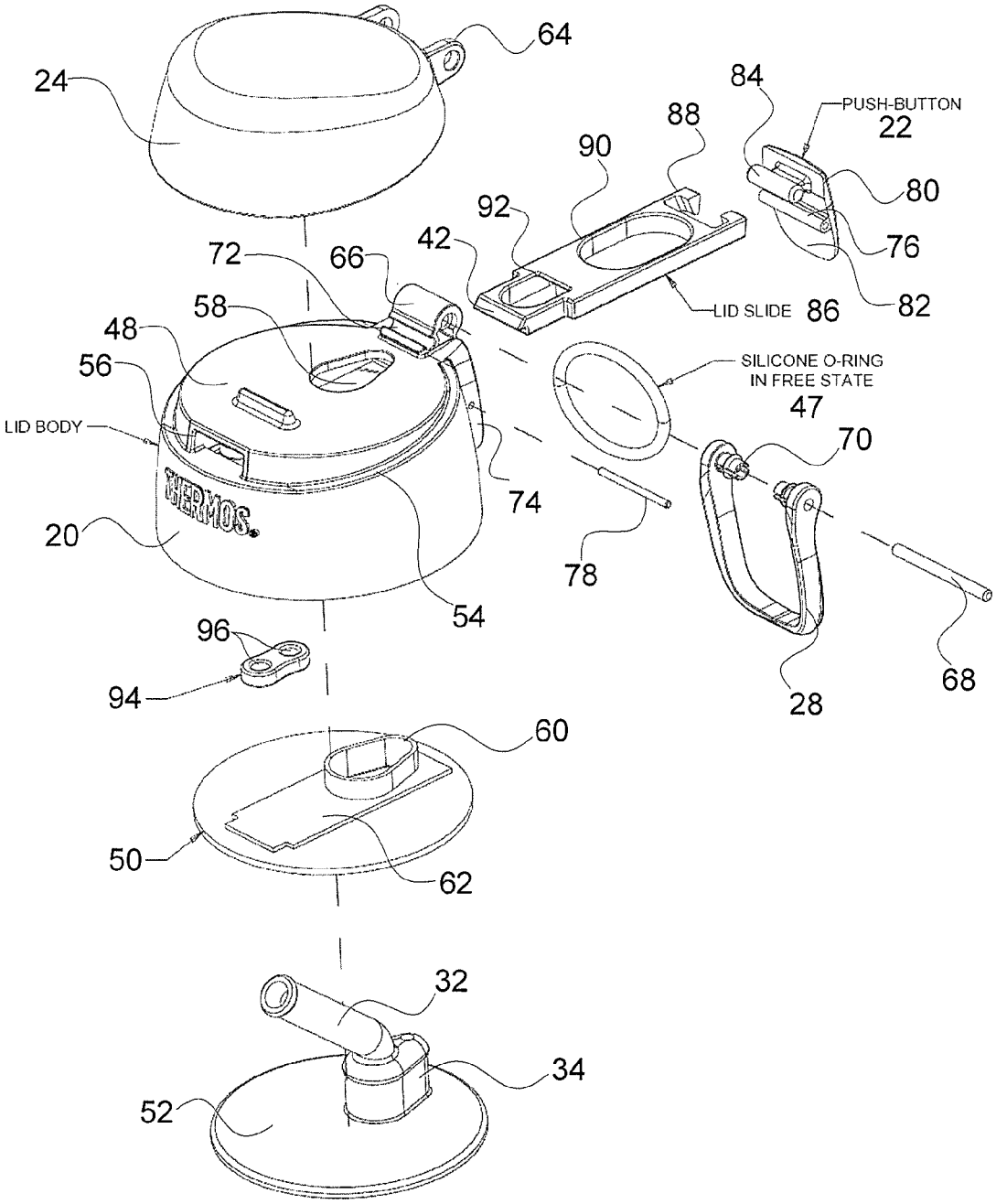
FIG. 3 is an exploded view of the removable lid of the present invention.
Figure 4:
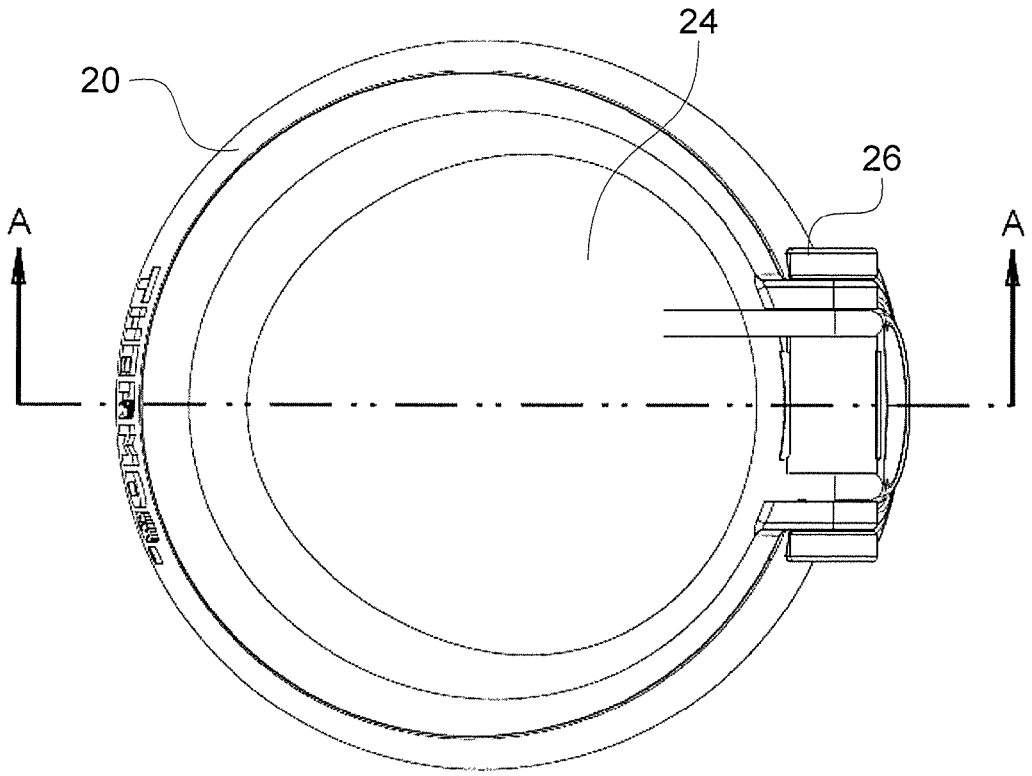
FIG. 4 is a top view of the removable lid of the present invention and including line A-A along which the cross section of FIG. 5 is taken.

As shown in FIG. 3, inner lid 20 may be comprised of upper cover 48, middle cover 50 and lower cover 52. Upper cover 48 may take many different configurations. In one embodiment, upper cover 48 contains spout opening 58 and has an upper section with a decreased diameter so that a ridge 54 is formed around all or part of the circumference of upper cover 48. The circumferential lower edge of outer lid 24 mates with ridge 54 to shield the upper portion of removable lid 14 from dirt and contamination and enclose spout 30 within its interior. Catch extension opening 56 is formed in the face of upper cover 48 perpendicular to ridge 54. Catch extension 42 extends through catch extension opening 56, except when push button 22 is actuated thereby causing catch extension 42 to be pulled into catch opening 56.

Middle cover 50 is sized with a diameter such that when middle cover 50 is inserted into upper cover 48 during manufacturing, the peripheral upper edge of middle cover 50 contacts the internal lower edge of ridge 54 to form a compartment between upper cover 48 and middle cover 50 that has catch extension opening 56 on one side and a push button opening (not shown in this view) directly opposite. Lower cover 52 has the same diameter configuration as middle cover 50. Pedestal 34 extends upward from the top of lower cover 52, and drinking tube 32 extends from pedestal 34.

On assembly, drinking tube 32 and pedestal 34 are inserted through spout opening extension 60 and upper cover 48, middle cover 50 and lower cover 52 are then connected together to form inner lid 20. The covers may be attached together in any known manner. Seals may be used to prevent liquids from passing between the covers that form inner lid 20. In an alternate embodiment, inner lid 20 may be formed from two covers. In such an alternate embodiment, the structures of middle cover 50 and lower cover 52 may be combined into one structure.

In one embodiment, when outer lid 24 is released from inner lid cover 20 by the actuation of push button 22 thereby causing disengagement of catch extension 42 from catch notch 44, outer lid 24 moves toward an open position in part by the biasing force of spout 30 acting on bending flange 38 as will be discussed below. Outer lid 24 is also moved toward a fully open position and may be automatically held in the fully open position by a lid biasing mechanism. Lid biasing element 47, shown in FIG. 2 in its assembled configuration and in FIG. 3 in its free state, in one embodiment is a silicone O-ring that extends between inner lid 20 and outer lid 24. More particularly, lid biasing element 47 is inserted into biasing element slot 72 either attached to or formed near the peripheral upper edge of inner lid 20 adjacent to hinge 26. In one embodiment, biasing element slot 72 is formed integrally with inner lid hinge 66. Biasing element 47 then passes behind each end of pin 68, through outer lid slots 69 and around biasing element attachment 71 located on an interior surface of outer lid 24. In its free state, lid biasing element 47 takes the shape of an O-ring and is made of a flexible material that is resilient and biases outer lid toward the fully open position by exerting tension forces thereon. When outer lid 24 is in the closed position, lid biasing element 47 is bent almost 180 degrees back on itself when it extends from biasing element slot 72, around the ends of pin 78 to connect with biasing element attachment 71. Since lid biasing element 47 is stretched, it exerts tension forces to cause outer lid 24 to move toward the open position and to be retained there. Lid biasing element 47 may be made of other materials and have other configurations.

In addition to the force exerted by lid biasing element 47, the drink spout 56 is in the crimped position as a result of being pressed by the bending flange 38 and against the counter ridge 72 when the cover is in the closed position. The resilient nature of the drink spout 56 and the material of which it is formed biases the outer lid 24 toward the open position as a result of the bending flange 38 pressing on the spout material. As a result, the spout provides a primary force for initial opening the outer lid 24 upon actuation of the release button 22. Further opening force to the fully open position is provided by the biasing element 47. The biasing element 47 may provide a primary force for moving outer lid 24 to the fully open position or the lid may be moved toward the fully open position by the user and retained there by the biasing element 47. The force of the biasing element 47 on the outer lid 24 is easily overcome by the user to move the outer lid 24 to the closed position.

Figure 5:
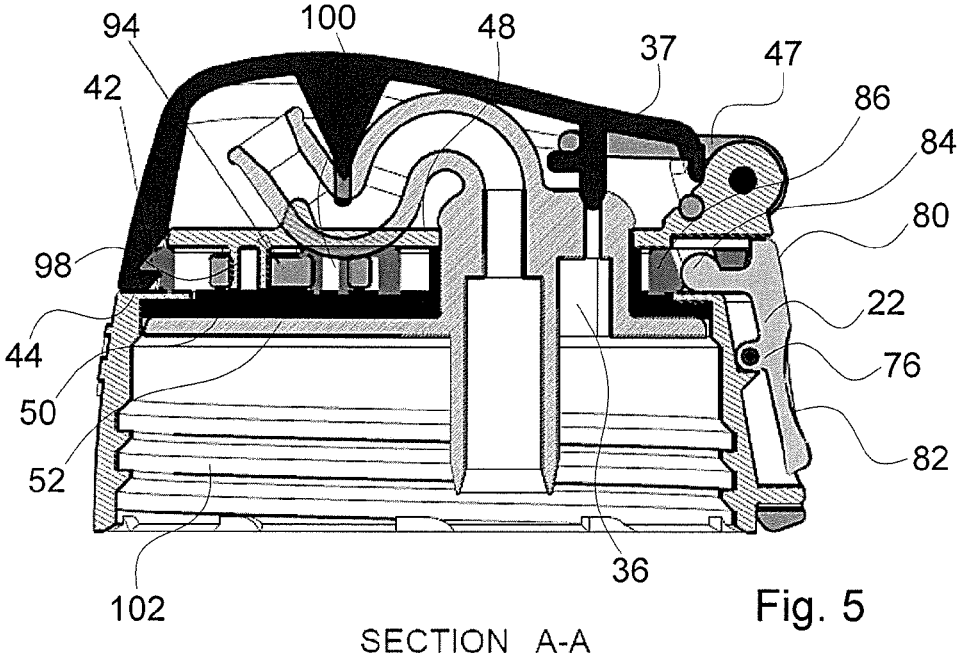
FIG. 5 is a side cross-sectional view of the removable lid in a closed position taken along the section line A-A as shown in FIG. 4.
Figure 6:
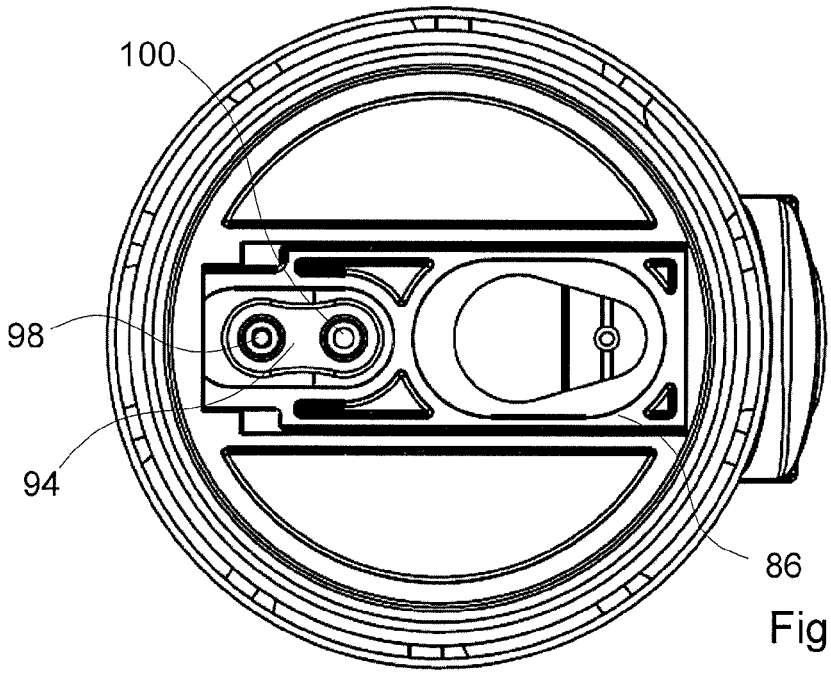
FIG. 6 is a top cross-sectional view of the removable lid in the closed position.

The lid release mechanism is comprised of push button 22, lid slide 86 and slide biasing element 94. In one embodiment, push button 22 has a pivotal connection 76 that holds it within push button frame 74 by pin 78. Pivotal connection 76 sections push button 22 into upper end 80 and lower end 82 thereby allowing a rocking movement around the pivotal connection. Slide engagement extension 84 extends from upper end 80 of push button 22 and engages with button engagement extension 88 of lid slide 86. Lid slide 86 is located within the interior space between upper cover 48 and middle inner cover 50. The opposite end of lid slide 86 contains catch extension 42 that protrudes from catch extension opening 56. As shown in FIG. 5, lid slide 86 contains slide bias support 100, which extends perpendicular to the length of lid slide 86. Cover bias support 98 extends from upper cover 48 but may also extend from middle inner cover 50. Slide bias support 100 and cover bias support 98 extend through holes 96 in slide biasing element 94. Slide biasing element 94 may be made of a resilient material such as silicone that tends to keep its shape, or may be made of a spring-like material that has the property of biasing towards its original shape. Slide bias support 100, cover bias support 98 and slide biasing element 94 are positioned such that catch extension 42 of lid slide 86 extends from catch extension opening 56 when slide biasing element is in its relaxed state, as shown in FIGS. 5 and 6.

Figure 7:
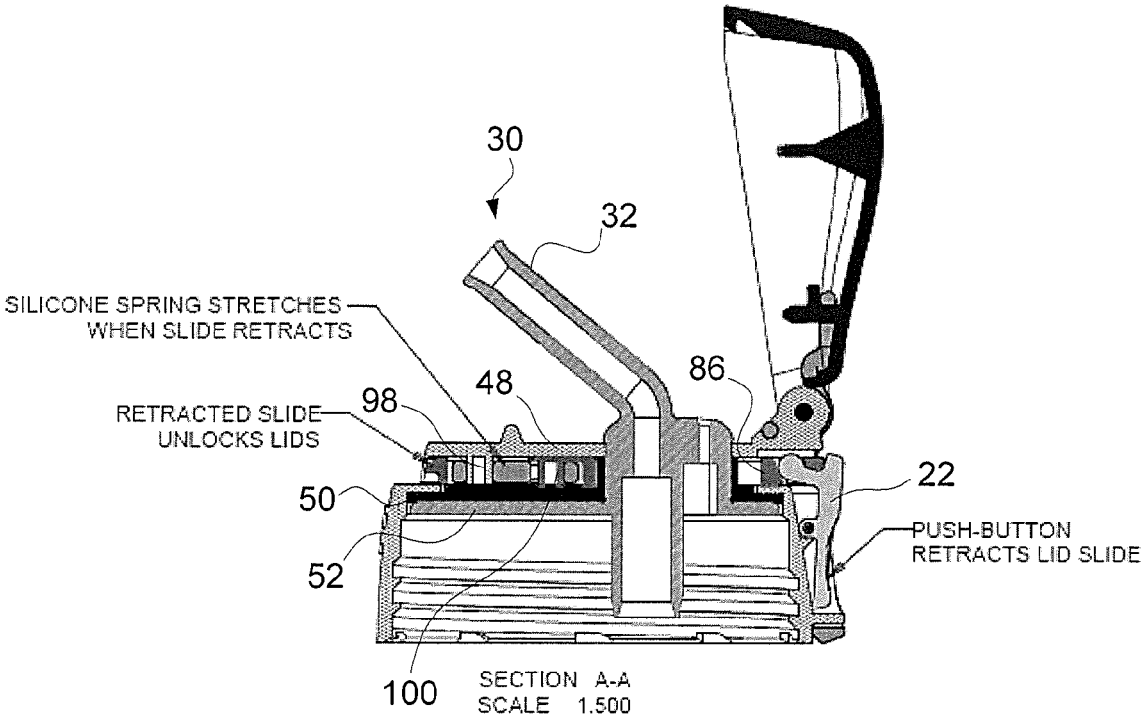
FIG. 7 is a side cross-sectional view of the removable lid in the open position taken along the same section line A-A as shown in FIG. 4.
Figure 8:
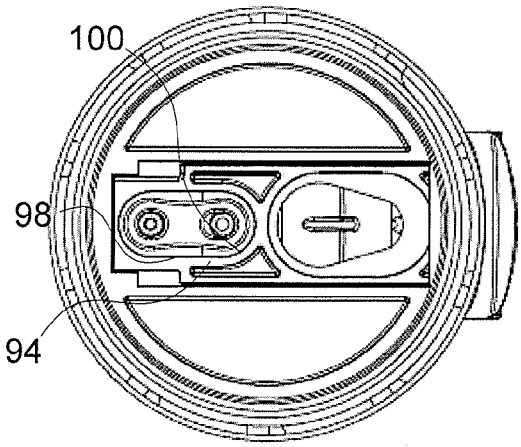
FIG. 8 is a top cross-sectional view of the removable lid in the closed position.

On pushing lower end 82 of push button 22 towards the radial center of removable lid 14, upper end 80 moves radially outward. This motion pulls lid slide 86 in the direction towards a side of the lid with the push button 22 and causes catch extension 42 to be retracted into catch extension opening 56. Retracting catch extension 42 causes it to disengage from catch notch 44 of outer lid 24 thereby releasing outer lid 24 from the closed and latched position so that it may move into the open position. The retracted position of lid slide 86 with outer lid 24 in the open position is shown in FIGS. 7 and 8. As apparent in FIG. 8, slide biasing element 94 is in an extended state because it is being stretched between cover bias support 98 and slide bias support 100, and exerts a force on them bringing them towards each other.

On releasing push button 22, slide biasing element 94 retracts from its stretched condition to cause lid slide 86 to move away from the side of the lid with the push button 22 and back into its original position. Thus, catch extension 42 can be moved out of engagement with catch notch 44, but is biased back into its original position through slide biasing element 94. In another embodiment, slide biasing element 94 may be connected between push button 22 and inner lid 20 within push frame 74. In such an embodiment, the biasing may be either through, for example, the expansion or compression of a spring or other resilient material.

To keep lid slide 86 in its proper position, middle inner cover 50 may contain frame 62 that provides a guide for the lower sides of lid slide 86. Lid slide 86 may also contain spout opening 90 to provide clearance for spout opening extension 60 and allow passage of drink spout 30 from the interior of the bottle through inner lid cover 20. While the illustrated embodiment shows a notch in the outer lid and an extension on the end of the lid slide, alternative embodiments may be used such reversing the locations of the notch and extension or use of other mechanical or magnetic locking mechanisms.

The outer lid 24, and inner lid 20 are of polypropylene in one embodiment, but may be made of any number of plastics such as PET, HDPE, LDPE or other polyesters. The release button 22 may be of polypropylene or another material. As noted above, the drink spout 56 and spring 96 are of silicone rubber. Other materials are of course possible and are encompassed within the scope of the present invention.

Thus, there has been shown and described a drink bottle having a removable lid that has a drinking spout and a lockable cover or outer lid over the drinking spout. Although other modifications and changes may be suggested by those skilled in the art, it is the intention of the inventor to embody within the patent warranted hereon all changes and modifications as reasonably and properly come within the scope of his contribution to the art.

I claim:

1. A drink bottle and lid, comprising:

a bottle having a mouth with a lid engaging structure;

a removable lid having a cooperating engaging structure for selective engagement with the lid engaging structure of the bottle;

the removable lid including an inner lid and an outer lid, the inner lid including the cooperating engaging structure, the inner lid defining a spout opening, the inner lid including a first hinge portion;

the outer lid including a catch notch and a second hinge portion for pivoting engagement with said first hinge portion so that said outer lid is pivotable relative to said inner lid between an open position and a closed position;

a push button having a pivot such that actuating one end of the push button radially inward towards a center line of the bottle causes a second end of the push button to move radially away from the center line of the bottle;

a lid slide moveable between an outer lid-locking position and an outer lid-releasing position, the lid slide having one end coupled to the second end of the push button through a push button opening and a second end having a catch extension for engagement with the catch notch of the outer lid;

a biasing element coupled between the lid slide and inner lid to bias the lid slide into the lid-locking position, wherein actuating the push button causes the lid slide to move to the lid-releasing position in opposition to a biasing action of the biasing element; and a drink spout mounted in said spout opening of said inner lid, said drink spout extending from said inner lid at a position to permit a user to drink fluid contained within the bottle from the drinking tube when said outer lid is in the open position, said outer lid covering said drink spout when said outer lid is in said closed position; and a second biasing element coupled between the inner lid and the outer lid to bias the outer lid into the open position.

2. A drink bottle and lid as claimed in claim 1, wherein said second biasing element is an O-ring.

3. A drink bottle and lid as claimed in claim 1, wherein the biasing element is a silicone spring that stretches when the lid slide is moved from the lid-locking position to the lid-releasing position.

4. A drink bottle and lid as claimed in claim 1, wherein the drink spout passes through a spout clearance opening in the lid slide.

5. A drink bottle and lid as claimed in claim 1, further comprising:

a handle coupled to the inner lid.

6. A drink bottle and lid as claimed in claim 1, further comprising:

a drinking tube bending flange on an interior face of the outer lid; and a drinking tube center ridge on the inner lid, wherein when the outer lid is in the closed position, the bending flange and center ridge cooperate to substantially seal the drinking tube.

7. A drink bottle and lid, comprising:

a bottle with a mouth;

a removable lid attached to the bottle over the mouth, the removable lid having, an outer lid with a catch notch on a circumferential edge, an inner lid with an upper inner lid cover and a lower inner lid cover, with the inner lid being pivotally coupled to the outer lid at a location opposite the catch notch, a drinking tube passing through the upper and lower inner lid covers, a push button pivotally connected to the inner lid between an upper end and lower end of the push button, a lid slide coupled to the upper end of the push button and located between the upper and lower inner lid covers, the lid slide extending substantially across the diameter of the upper and lower inner lid covers and terminating in a catch extension such that when the outer lid is closed over the inner lid, the catch extension engages the catch notch to keep the outer lid closed over the inner lid, a slide biasing element coupled between the inner lid and either the lid slide or push button that biases the lid slide outwardly in the direction of the catch extension, wherein actuating the lower end of the push button causes the upper end of the push button to move the lid slide against the biasing of the slide biasing element and disengages the catch extension from the catch notch; and a lid biasing element extending between the outer lid and inner lid at a location proximate to the ends of the pivotal couple between the outer and inner lids to bias the outer lid into the open position.

8. A drink bottle and lid as claimed in claim 7, wherein said lid biasing element is an O-ring.

9. A drink bottle and lid as claimed in claim 7, wherein the biasing element is a silicone spring.

10. A drink bottle and lid as claimed in claim 7, wherein the drink spout passes through a spout clearance opening in the lid slide.

11. A drink bottle and lid as claimed in claim 7, further comprising:

a handle coupled to the inner lid.

12. A drink bottle and lid as claimed in claim 7, further comprising:

a drinking tube bending flange on an interior face of the outer lid; and a drinking tube center ridge on the inner lid, wherein when the outer lid is in the closed position, the bending flange and center ridge cooperate to substantially seal the drinking tube.

13. A drink bottle and lid, comprising:

a bottle having a mouth with a lid engaging structure;

a removable lid having a cooperating engaging structure for selective engagement with the lid engaging structure of said bottle;

said removable lid including an inner lid and an outer lid, said inner lid including said cooperating engaging structure for engagement with said bottle, said inner lid and said outer lid being selectively securable to one another in a closed position, said inner lid defining a spout opening;

a drink spout mounted in said spout opening of said inner lid, said drink spout extending from said inner lid at a position to permit a user to drink fluid contained within the bottle from the drinking tube when said outer lid is in an open position, said outer lid covering said drink spout when said outer lid is in said closed position;

said inner lid including a first hinge portion, said outer lid including a second hinge portion for pivoting engagement with said first hinge portion so that said outer lid is pivotable relative to said inner lid between said open position and said closed position; and a retractable outer lid locking mechanism located within an upper and lower inner lid cover;

the retractable outer lid locking mechanism actuatable by a push button coupled to a proximal end of a lid slide with a locking feature located on a distal end of the lid slide, the locking feature being biased by a biasing element in a direction towards the distal end of the lid slide, wherein in the locked position the locking feature engages a mating locking feature of the upper lid to keep the lid closed and the lid slide being actuable by the push button to move towards the proximate end of the lid slide against the biasing of the biasing element to disengage the locking feature from the mating locking feature.

14. A drink bottle and lid as claimed in claim 13, further comprising:

a lid biasing element coupled between the inner lid and the outer lid and extending radially outward on each side of a pin that couples the first and second hinge portions, where the lid biasing element biases the outer lid into the open position.

15. A drink bottle and lid as claimed in claim 13, wherein the biasing element is a silicone spring that increases bias when the lid slide is moved from the lid-locking position to the lid-releasing position.

16. A drink bottle and lid as claimed in claim 13, wherein the drink spout passes through a spout clearance opening in the lid slide.

17. A drink bottle and lid as claimed in claim 13, further comprising:

a handle coupled to the inner lid.

18. A drink bottle and lid as claimed in claim 13, further comprising:

a drinking tube bending flange on an interior face of the outer lid; and a drinking tube center ridge on the inner lid, wherein when the outer lid is in the closed position, the bending flange and center ridge cooperate to substantially seal the drinking tube.

* * * * *